United States Patent [19]

Dageford

[11] 3,967,281

[45] June 29, 1976

[54] DIAGNOSTIC ANNUNCIATOR

[75] Inventor: Ernest C. Dageford, Irvine, Calif.

[73] Assignee: BEC Products, Inc., Irvine, Calif.

[22] Filed: Jan. 20, 1976

[21] Appl. No.: 543,017

[52] U.S. Cl. ..... 340/415; 340/52 F; 340/213 R; 340/223

[51] Int. Cl.[2] ..... G08B 19/00

[58] Field of Search ..... 340/52 F, 213 R, 223, 340/412, 414, 415

[56] References Cited

UNITED STATES PATENTS

| | | | |
|---|---|---|---|
| 3,264,613 | 8/1966 | Stolle | 340/415 UX |
| 3,729,734 | 4/1973 | Kipling | 340/415 |

*Primary Examiner*—Alvin H. Waring
*Attorney, Agent, or Firm*—Charles H. Schwartz

[57] ABSTRACT

An annunciator is adapted for use with a boiler having a flame safeguard programmer providing a first signal and a second signal representative of respective first and second occurring faults in the boiler. The programmer also provides an alarm signal when the flame of the boiler is out. The annunciator includes means responsive to the first signal for providing a fist indication representative of the first fault. Similarly, means is responsive to the second signal to provide a second indication representative of the second fault. Means is provided for inhibiting the second indication until the fault associated with the first indication has been corrected so that the second indication begins with the correction of the first occurring of the faults and terminates with the correction of the second occurring of the faults. Means is provided for resetting the annunciator when nuisance shutdowns are self-corrected. Memory means is provided for maintaining the indication of serious malfunctions they may have self-corrected. "No pilot" and "main fuel" indications are provided from a single alarm contact in the flame safeguard programmer. A time delay is provided to inhibit the indication of certain faults during an initial startup period.

17 Claims, 2 Drawing Figures

DIAGNOSTIC ANNUNCIATOR

BACKGROUND OF THE INVENTION

1. Field of the Invention

The present invention is concerned primarily with commercial and industrial burner/boilers and more specifically with a diagnostic annunciator adapted to provide operating and fault indications for the boiler.

2. Description of the Prior Art

The present invention is adapted for use with flame safeguard programmers which are commonly used in conjunction with commercial and industrial burner/-boilers. These programmers perform a safeguard function by automatically shutting down the boiler in response to various faults in the system. Were the boiler not shut down, these faults could result in severe explosions. It is known by those skilled in the art that these programmers typically include an operating control, a water level control, a high limit control, a fuel selector switch, a fuel pressure switch, a combustion air switch, an atomizing air switch, a pilot/ignition contact, a main fuel contact, an alarm contact, and a blower motor contact.

When a failure or fault occurs in a conventional burner system, the flame safeguard programmer sometimes goes to a lockout condition. The lockout may be caused by one or more of the following conditions which may occur simultaneously: main fuel failure, pilot failure, combustion air failure, fuel pressure failure, atomizing air failure, and other interlock failures. In some cases, a particular type of failure will cause other types of failure to occur. For example, a combustion air failure might ultimately produce a main fuel failure and a pilot failure in a lockout condition.

In the past there has been no means for rapidly and effectively determining the specific failure which has caused the lockout condition. As a consequence, it has been difficult to ascertain what type of fault has produced the particular condition of the boiler. Valuable time has been wasted in determining the cause of the problem since it has not been immediately apparent. To compound the problem, a particular failure may be discovered and corrected. However, where this particular failure resulted due to earlier occuring failure, the primary cause of the lockout condition has remained to be corrected.

SUMMARY OF THE INVENTION

In accordance with the present invention, a diagnostic annunciator is provided which is adapted for use with the flame safeguard programmers of the prior art. The annunciator has various indicating lights which indicate the specific nature of a fault when it occurs. Furthermore, the annunciator is capable of differentiating between nuisance shutdowns and serious malfunctions. For the nuisance shutdowns, momentary limit trips are self-correcting as soon as acceptable limits are established. Memory means is provided for maintaining indications of serious malfunctions, however, even though these functions may have self-corrected.

The annunciator can be formed from solid state devices and may require no separate power source. It does not require continuous series circuitry with the programmer but rather may be wired directly to existing terminals in the programmer.

It is particularly advantageous that the annunciator contains logic circuitry for indicating the first failure which results in a lockout condition, and for maintaining only that indication even though other failures may ultimately occur. When the primary failure is corrected, then secondary failures will be indicated until they are corrected. Thus an immediate indication is provided as to the primary failure so that the boiler can be brought back on line as soon as possible.

The annunciator can be adapted for use with both the recycling and nonrecycling types of systems. In a recycling type of system, an indicator light may remain on as long as the fail condition continues. When the fail condition is rectified, the light will automatically reset. In a nonrecycling type of system, a momentary interruption of a particular control in the programmer will store that information and maintain its display while the frame safeguard device recycles to a lockout condition.

These and other features and advantages of the present invention will become more apparent with the description of preferred embodiments discussed with reference to the associated drawings.

DESCRIPTION OF PREFERRED EMBODIMENTS

Figure 1:
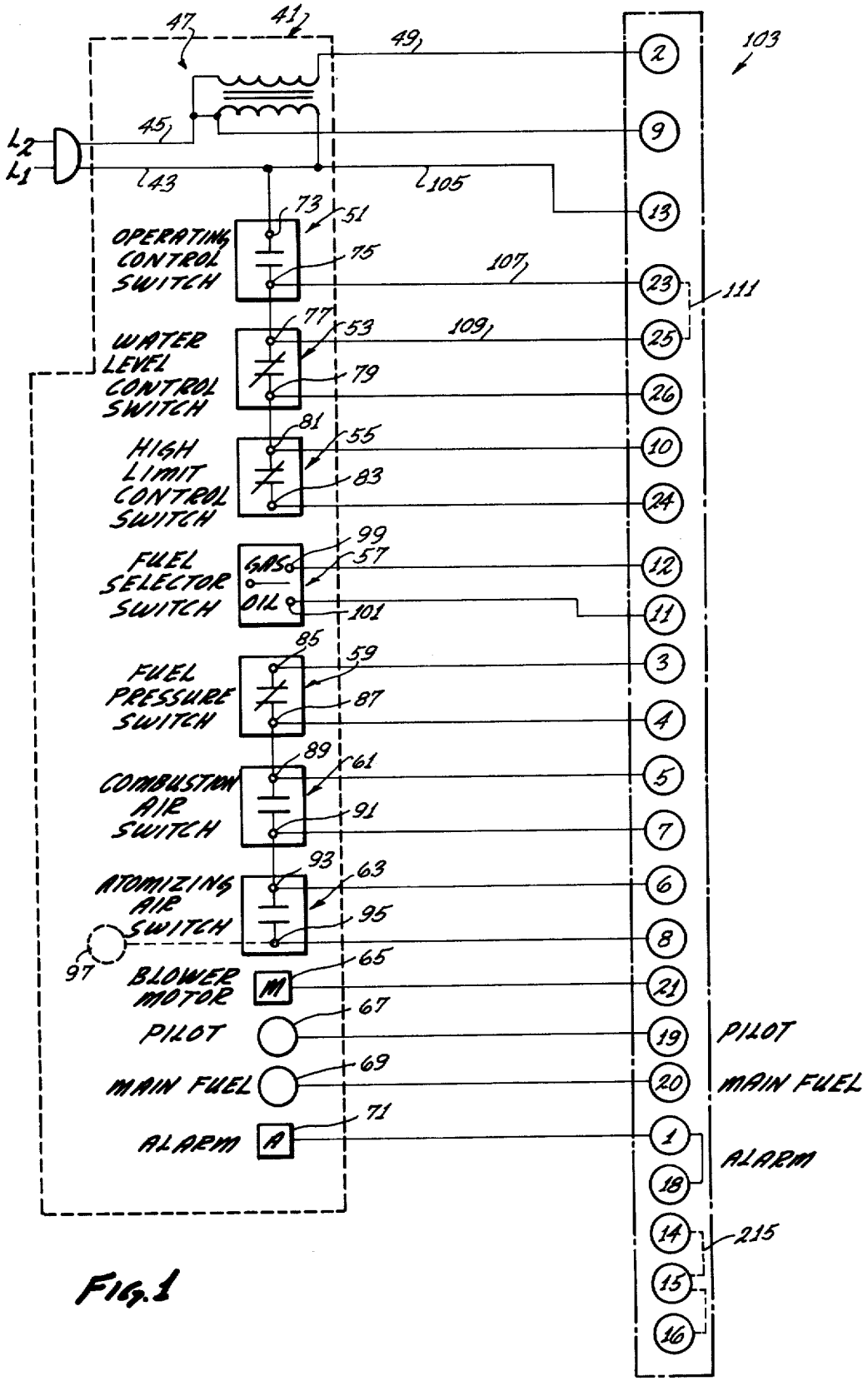
FIG. 1 is a block diagram of an annunciator of the present invention and a flame safeguard programmer illustrating preferred connections between the annunciator and the programmer.

A flame safeguard programmer is illustrated generally in FIG. 1 and designated by the reference numeral 41. The programmer 41 can be of the type commonly used in conjunction with commercial and industrial burner/boiler such as those manufactured by Fireye and Honeywell. These programmers 41 are adapted to receive a 110 volt AC signal and a reference signal on a pair of lines 43 and 45, respectively, which are typically connected across the primary coil of a transformer 47. The transformer 47 provides an alternating current voltage such as 24 volts on a conductor 49.

The programmer 41 will typically include an operating control switch 51, a water level control switch 53, a high limit control switch 55, a fuel selector switch 57, a fuel pressure switch 59, a combustion air switch 61, and an atomizing air switch 63. The programmer 41 may also include a blower motor contact 65, a pilot contact 67, a main fuel contact 69, and an alarm contact 71.

The switches 51, 61 and 63 normally have an open state while the switches 53, 55 and 59 normally have a closed state. With the exception of the fuel selector switch 57, each of the switches 51–63 is a single pole, single throw switch having a pair of contacts. Thus the operating control switch 51 has a contact 75 and a contact 73 which is connected to the line 43. The water level control switch 53 has a contact 79 and a contact 77 which is connected to the contact 75. The high limit switch 55 has a contact 83 and a contact 81 which is connected to the contact 79. The fuel pressure switch 59 has a contact 87 and a contact 85 which is connected to the contact 83. The combustion air switch 61 has a contact 91 and a contact 89 which is connected to the contact 87. Finally, the automization air switch 63 has a contact 93 which is connected to the contact 91, and a contact 95 which is connected to a further terminal 97 in the programmer 41.

The fuel selector switch 57 is a single pole, double throw switch having a contact 99 representative of a gas mode of operation, and a contact 101 representative of an oil mode of operation.

Each of these contacts 73–101 can be connected to respective terminals in an annunciator of the present invention which is illustrated generally at 103 in FIG. 1. The terminals of the annunciator 103 are shown in FIG. 1 as circles having consecutive reference numerals between 1 and 26. The terminals 1–26 are illustrated in a column in FIG. 1 to show a preferred means for connecting the annunciator 103 to the programmer 41.

Figure 2:
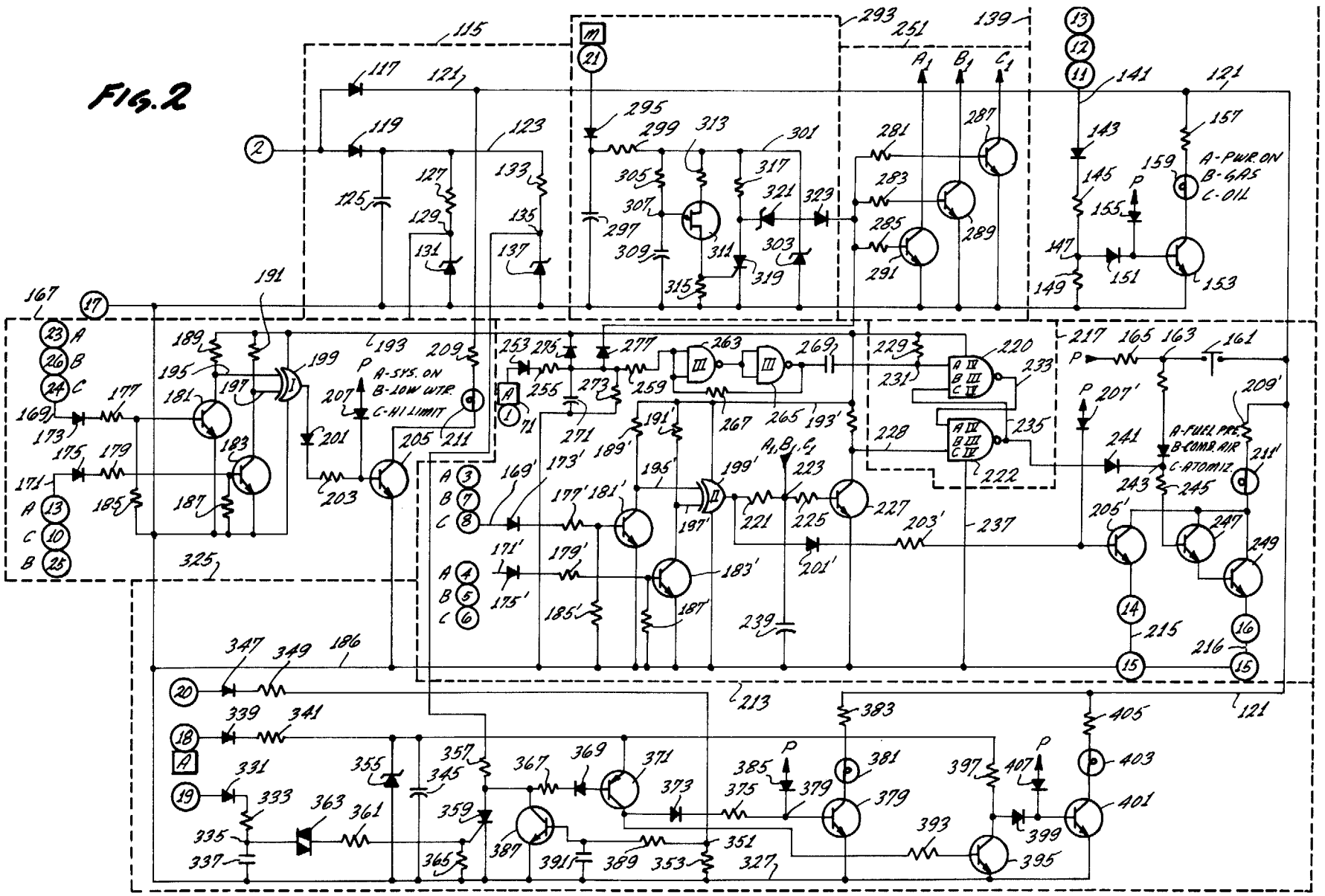
FIG. 2 is a schematic diagram of the annunciator illustrated in the block diagram of FIG. 1.

The annunciator 103 is illustrated in greater detail in FIG. 2 wherein the terminals 1–26 are also designated by circles enclosing the associated reference numeral. The connections between the programmer 41 and the annunciator 103 can be made as illustrated in FIG. 1. For example, the contact 73 in the programmer 41 can be electrically connected through a conductor 105 to the contact 13 in the annunciator 103. Similarly, the contact 75 and 77 in the programmer 41 can be electrically connected through conductors 107 and 109, respectively, to contacts 23 and 25, respectively, in the annunciator 103. With reference to FIG. 1, other connections between the contacts 73–101 of the programmer 41 and the terminals 1–26 of the annunciator 103 will be obvious to those skilled in the art.

The illustrated connections between the contacts 73–101 and the terminals 1–26, wherein each of the switches 51–63 is connected to the programmer 41 through a pair of conductors, may be desirable in certain types of systems. It will be apparent, however, that fewer conductors can be provided between the programmer 41 and the annunciator 103 by providing jumpers in the annunciator 103. For example, rather than providing the two conductors 107 and 109 for the contacts 75 and 77, respectively, the single conductor 107 can be provided between the programmer 41 and the annunciator 103 if a jumper, illustrated by a dotted line 111, is provided between the contacts 23 and 25 in the annunciator 103. In such an embodiment, the conductor 109 can be eliminated. Other conductors between the programmer 41 and the annunciator 103 could be eliminated by providing corresponding jumpers similar to that illustrated by the line 111. This single conductor type of connection might be more desirable where the annunciator 103 and the programmer 41 were separated by a significant distance.

Referring now to FIG. 2, it will be noted that in a preferred embodiment of the annunciator 103, a power supply section 115 can be connected to receive the 24 volt AC power on terminals 2 and 17. The power supply section 115 includes a pair of diodes 117 and 119 having their anodes connected to the terminal 2 and having their cathodes connected to conductors 121 and 123, respectively. A capacitor 125 is connected between the conductor 123 and the terminal 17. Similarly, the conductor 123 is connected through a resistor 127, a terminal 129, and the cathode of a Zener diode 131. The anode of the diode 131 is connected to the terminal 17. The conductor 123 is also connected through a resistor 133, a terminal 135, and in a reverse direction, through a Zener diode 137 to the terminal 17.

The diodes 117 and 119 are single or half-wave rectifiers. The diode 119 in conjunction with the capacitor 125, the resistor 127, and the Zener diode 131, can be provided with appropriate values to produce a five volt $V_{cc}$ signal on the terminal 129. A 22 volt supply is provided on the terminal 135 by the diode 119, the capacitor 125, the resistor 133, and the Zener diode 137. In this preferred embodiment, the 22 volts supply is used in a memory associated with a circuit providing indications of no pilot failure and no main fuel failure conditions. This circuit will be discussed in greater detail below. The diode 117 provides an appropriate power supply voltage for various indicator lamps in the annunciator 103. The circuits associated with these lamps will also be discussed in greater detail below.

A section 139 in the upper right-hand corner of FIG. 2 is representative of a circuit, three of which are included in the annunciator 103 in a preferred embodiment. These three circuits, which provide visual indications of respective conditions of the boiler, will be designated by the reference letters A, B and C. The circuit A is associated with a "power on" indication, the circuit B with a "gas" indication, and circuit C with an "oil" indication. Although these three circuits A, B and C are illustrated in a single section 139, it will be understood that they are three separate circuits in the annunciator 103, each connected to the conductor 121 and the terminal 17. Similar components in the separate circuits A, B and C will be referred to by the same reference numeral, followed by the reference letter A for the "power on" circuit A, B for the "gas" circuit B, and C for the "oil" circuit C.

A conductor 141 can be connected to the terminals 13, 12 or 11 for each of the respective indication circuits A, B or C respectively. In each of the circuits A, B and C, the conductor 141 can be connected in a forward direction through a diode 143, a resistor 145, a terminal 147, and a resistor 149 to the terminal 17. A diode 151 can be connected in a forward direction from the terminal 147 to the base of a transistor 153. Similarly, a diode 155 can be connected in a forward direction from a terminal P to the base of the transistor 155. The conductor 121 can be connected through a resistor 157 and an indicator or lamp 159 to the collector of the transistor 153. Finally, the emitter of the transistor 153 can be connected to the terminal 17.

When the power is turned on, a gas mode of operation is chosen, or an oil mode of operation is chosen, a 110 volt AC signal is introduced to the terminals 13, 12 or 11, respectively. When the conductor 141 receives this signal in the respective circuit A, B or C, a half-wave rectification occurs as a result of the diode 143. The rectified signal at the cathode of the diode 143, which is in phase with the 24 volt low voltage power, provides base voltage to turn on the transistor 153. This causes the associated lamp 159 to glow and provide the desired indication.

The terminal P can be energized by a press-to-test switch 161 (illustrated below the section 139 in FIG. 2) which can be connected from the conductor 121 through a terminal 163 and a resistor 165 to the terminal P. By closing the press-to-test switch 161, a supply voltage can be introduced to the base of the transistor 153 to light each of the three lamps 159 A, B and C to test their visual indications. Other connections will be made to the terminal P throughout the annunciator 103 to provide for the testing of the various indicators throughout the system.

Three additional indicators are actuated by a section of the circuit designated by the reference numeral 167 at the left-hand side of FIG. 2. As with the section 139, the section 167 is representative of three separate sections each connected in the manner illustrated to receive the signals on the terminal 17, the terminal 129, and the conductor 121. These circuits, which are independently actuated, can provide the following indications which are distinguished in FIG. 2 by the associated capital letter: "system on" (A), "low water" (B), and "high limit" (C).

Each of the separate circuits A, B and C in the section 167 includes a pair of conductors 169 and 171 which are connected to an associated pair of terminals of the annunciator 103. For example, for the "system on" indication, the conductors 169A and 171A are connected to the terminals 23 and 13 respectively. Similarly, for the "low water"indication, water" conductors 169B and 171B are connected to the terminals 26 and 25, respectively. Finally, the terminals 24 and 10 of the annunciator 103 are connected to the conductors 169C and 171C for the "high limit" indication.

In the section 168, the conductors 169 and 171 can be connected in a forward direction through a pair of diodes 173 and 175 and a pair of resistors 177 and 179, to the bases of a pair of transistors 181 and 183, respectively. Each of the bases of the transistors 181 and 183 is connected through a respective resistor 185 and 187 to both of the emitters of the transistors 181 and 183. The emitters of the transistors 181 and 183 can also be connected to the terminal 17 through a conductor 186.

The collectors of the transistors 181 and 183 can be connected through respective resistors 189 and 191 to a conductor 193 which is connected to the terminal 129 in the power supply section 115. The collectors of the transistors 181 and 183 can also be connected through conductors 195 and 197 to various pins of an integrated circuit (IC) network 199. The IC network 199 in a preferred embodiment is of the type commonly designated by the catalog number 7486. A single one of these IC networks can be connected simultaneously to the circuits A, B and C of the section 167.

The various pins of the network 199 to which the conductors 195 and 197 are connected depend upon the particular circuit A, B or C with which the conductors 195 and 197 are associated. For the "system on" indication, the conductors 195 and 197 can be connected to the pins 5 and 4 of the circuit 199. For the "low water" indication, these conductors 195 and 197 can be connected to the pins 12 and 13 respectively, and for the "high limit" indication, the conductors 195 and 197 can be connected to the pins 2 and 1 respectively.

The pin 14 of the IC network 199 can be connected to the conductor 193 for each of the circuits A, B and C. Similarly, the pin 7 in the network 199 can be connected to the emitter of the transistor 183.

The output of the network 199 can be taken from the pins 6, 11 and 3 for the indicator circuits A, B and C, respectively. This output signal from the network 199 can be introduced in a forward direction through a diode 201 and a resistor 203 to the base of a transistor 205. Similarly, the press-to-test terminal P can be introduced in a forward direction through a diode 207 to the base of the transistor 205. To complete the circuits A, B and C in the section 167, the conductor 121 can be connected through a resistor 209 and a lamp 211 to the collector of the transistor 205.

The circuits A, B and C of the section 167 operate in the following manner for the illustrated embodiment. When a signal appears on either of the conductors 169 or 171, the associated transistor 181, 183 respectively will generate a squarewave signal. This signal, which may be 5 volts, for example, will have approximately a 50 percent duty cycle dependent upon the frequency of the associated signal on the conductors 169 and 171. For example, if the line frequency is 60 Hertz, the squarewave signals will have approximately a fifty percent duty cycle with 8.3 milliseconds on and 8.3 milliseconds off. A 50 Hertz line signal would provide a duty cycle of approximately 10 milliseconds on and 10 milliseconds off.

When one of the switches 51, 53 and 55 is closed, the conductors 169 and 171 receive the same signal. In response to this condition, the transistors 181 and 183 provide their respective squarewave signals on the conductors 195 and 197. These signals, which are in phase, are introduced to the network 199. In response to these in phase signals, the network 199 provides at its output a signal having a low voltage, such as a zero voltage. This low voltage signal inhibits conduction through the transistor 205 so that the indicator 211 does not illuminate.

When one of the switches 51, 53 and 55 is switched to an open state, the signals on the conductors 169 and 171 in the respective circuit A, B and C will be provided with an offset. In other words, there will be a high voltage on one of the conductors 169 and 171 and a low voltage on the other of the conductors 169 and 171. Thus, only one of the transistors 181 and 183 would provide a squarewave signal on the conductors 195 and 197. In response to this condition, the network 199 would provide at its output a signal having a high voltage. This output signal will have substantially the same squarewave characteristics as the input signal. The high voltage output signal from the network 199 can be used as a base drive turning on and off the transistor 205 with the same duty cycle as the squarewave input signal. These oscillations would be in phase with the signals on the lines 43 and 45 and the signals at the output of the transistor 47.

Of course as the transistor 205 oscillates on and off, the associated lamp 211 will glow to provide the associated visual indication. It follows that when one of the switches 51, 53 and 55 is provided with an open state, the associate indicator 211 in the associated circuit A, B and C of the section 167 is illuminated to provide the desired indication.

With the connection through the diode 207, the press-to-test switch 161 can be actuated to test the lamps 211 in the circuits A, B and C represented by the section 167.

A further section of the annunciator 103 (to the right of section 167 in FIG. 2) is designated by the reference numeral 213. This section 213 is representative of three separate circuits, A, B and C which provide the associated indications of low fuel pressure (in circuit A), no combustion air (in circuit B), and no atomization air (in circuit C.) The circuits A, B and C represented by the section 213 can be similar to those described with reference to the section 167 when the flame safeguard programmer 41 is of the recycle type of programmer. This similarity is emphasized by providing similar components with the same reference numeral followed by a prime designation. Thus it can be seen that the circuits represented by the section 213 include conductors 169′ and 171′ which are connected to the terminals 3 and 4 in the circuit A, the terminals 7 and 5 in the circuit B, and the terminals 8 and 6 in the circuit C, respectively. The other numerals containing the prime designation in section 213 can be connected as indicated in FIG. 2 with reference to similar components in section 167.

The IC network 199′ can be of the type commonly designated by the catalog number 7486. This IC network 199′ can be used by each of the circuits A, B and C represented by the section 213. For example, the conductors 195′ and 197′ in the circuit A can be connected to pins 5 and 4 of the network 199′. In the circuit B these conductors can be connected to pins 9 and 10 and in the circuit C to pins 2 and 1, respectively. The outputs of the circuits A, B and C will then be provided at the pins 6, 8 and 3, respectively of the network 199′.

It can be seen that with a conductor 215 connected between the terminals 14 and 15 of the annunciator, the circuits A, B and C represented by the section 213 are substantially the same as those represented by the section 167. Thus with the energizing of the conductors 169′ and 171′, the corresponding lamps 211′ will indicate "low fuel pressure" in the circuit A, "no combustion air" in the circuit B, and "no atomization air" in the circuit C. More specifically, when the inputs to the conductors 169 and 171 are offset, the halfwave duty cycle will result at the lamp 211′.

As well known to those skilled in the art, nonrecycling types of controls include a main relay which drops out if either the fuel pressure switch 59, the combustion air switch 61 or the atomization air switch 63 remains open for an adequate duration. When this main relay drops out, the unit goes into a lockout condition and announces main fuel failure. Furthermore, the alarm contact 71, designated by a boxed letter A in the section 213, is energized with 110 volts when the flame detector (not shown) of the boiler signifies that there is no flame.

The present invention is particularly advantageous for use with this nonrecycling type of control since it provides memory means for maintaining the appropriate indication on the lamp 211′ even though the associated switch 59–63 remakes itself. This means is shown generally by a section 217 which includes a pair of NAND gates 220 and 222. The output of the network 199′ in the section 213 can be connected through a resistor 221, a terminal 223, and a resistor 225 to the base of a transistor 227. The collector of the transistor 227 can be connected through a conductor 228 to provide an input to the NAND gate 222. The emitter of the transistor 227 can be connected to the terminals 17 through the conductor 186. The $V_{cc}$ signal on the conductor 193 can be introduced through a resistor 229 and a terminal 231 to provide an input to the NAND gate 220. A conductor 233 can be connected from the output of the NAND gate 220 to provide another input to the NAND gate 222. Similarly, a conductor 235 can be connected to the output of the NAND gate 222 to provide another input to the NAND gate 220.

Connected in this manner, the NAND gates 220 and 222 function as a flip-flop, the output of which is provided on the conductor 235. Thus the section 217 functions in a manner such that two high signals on a terminal 231 and the conductor 228 will produce a low signal at the output of the NAND gate 222. Two low signals on the terminal 231 and the conductor 228 will produce a high signal at the output of the NAND gate 222. The combination of a low signal and a high signal on the terminals 231 and the conductor 228 will also create a high signal at the output of the NAND gate 222.

In a preferred embodiment of the invention, the NAND gates 220 and 222 are provided by a pair of IC networks III and IV of the type commonly designated by the catalog number 74 C 00. Each of these IC networks III and IV includes four NAND gates so that a pair of networks provides a total of eight NAND gates. The four NAND gates provided by the IC network IV can provide the NAND gates 220 and 222 in the circuits A and C. Two of the four NAND gates provided by the IC network III can provide the NAND gates 220 and 222 in the circuit B. The remaining two NAND gates on the IC network III can be connected in another section of the annunciator 103 described in greater detail below.

The IC networks designated by the catalog 74 C 00 each have a total of 14 connection pins. In a preferred embodiment, these pins of the IC networks III and IV are connected in the following manner. The terminal 231 is connected to the pins 10, 2 and 5 in the A, B and C circuits respectively. The conductor 228 is connected to the terminals 13, 13 and 1 in the A, B and C circuits respectively. At the output of the NAND gate 220, the terminals 8, 3 and 6 to the network are connected through the conductor 233 to the terminals 12, 12 and 2 of the NAND gate 222 for the A, B and C circuits respectively. Similarly, at the output of the NAND gate 222, the pins 11, 11 and 3 of the network are connected to the pins 9, 1 and 4 at the input of the NAND gate 220 for the A, B and C circuits respectively. If the NAND gates 220 and 222 are provided by the IC circuits III and IV, a $V_{cc}$ signal can be introduced to the NAND gate 220 on pin 14, while the pin 17 is connected through a conductor 237 and the conductor 186 to the terminal 117.

As previously mentioned, the pins 11, 11 and 3 provide the outputs of the circuits A, B and C respectively in the section 217. These pins can be connected in a forward direction through a respective diode 241, a terminal 243, and a resistor 245 to the base of a transistor 247. The transistor 247 can be Darlington coupled to a transistor 249 by connection between the emitter of the transistor 247 and the base of the transistor 249. The collectors of the transistors 247 and 249 are both coupled to the collector of the transistor 205′. The emitter of the transistor 249 can be connected to the terminal 16 of the annunciator 103. In the nonrecycling type of programmer 41, the conductor 215 is preferably removed from the terminals 14 and 15 and connected between the terminals 15 and 16 as illustrated by the dotted line 216 in FIG. 2.

The operation of the section 217 proceeds as follows. Under normal conditions, the inputs to the section 217 will both be high. That is, the signals on the pins 10, 2 and 5 and the pins 13, 13 and 1 will be all high. The input of the NAND gate 220 on pins 8, 3 and 6 will be low, thereby providing a high at the output of the NAND gate 222.

When the offset occurs on the terminals 3–4, 7–5, or 8–6 of the circuits A, B and C in the section 213, the signal at the output of the network 199′ will oscillate at the same rate as the offset frequency. To eliminate noise and spurious signals, these output signals are filtered by the resistor 221 and a capacitor 239 which can be connected between terminal 223 and the conductor 186. This filter generates a rectified and filtered DC voltage at the base of the transistor 227 through the resistor 225. This in turn produces a low voltage signal on the conductor 228 at the input to the NAND gate 222.

When this low voltage signal is combined with a normally high signal at the other input, the NAND gate 222 will switch to a high state. This signal, when combined with the other high signal at the input to the NAND gate 220, will switch the output of the NAND gate 220 to a low state. This low state, when introduced to the NAND gate 222 on the conductor 233, will combine with the low state on the conductor 228 to maintain the output of the NAND gate 222 in a high state.

A high state signal at the output of the section 217 will generate a base voltage through the diode 241 in the resistor 245 for the Darlington coupled transistors 247 and 249. This condition will turn on the transistor 249 thereby activating the lamp 211' in the associated circuit A, B or C.

A feature of particular advantage to the present invention is associated with sections designated by the reference numerals 251 and 252. These sections insure that the lamp 211' in the circuits A, B or C of the section 213 will indicate only the first occuring fault and inhibit all other indications until that fault is corrected.

In the section 252, the alarm contact, designated by the boxed A, from the programmer 41 can be connected to the terminal 1 as shown in section 252. When a fault occurs, this contact is energized with 110 volts. This signal can be introduced in a forward direction through a diode 253, a resistor 255, a conductor 257, and a resistor 259 to provide a pair of inputs to a NAND gate 263. The output of the NAND gate 263 can be connected to provide two inputs to a NAND gate 265. In a preferred embodiment, these two NAND gates 263 and 265 are the remaining two NAND gates on the IC network III previously mentioned with respect to the section 217. In this embodiment, the resistor 259 can be connected to pins 9 and 10 of the NAND gate 263 and pin 8 at the output of the NAND gate 263 can be connected to pins 4 and 5 at the input of the NAND gate 265. The output of the NAND gate 265 on pin 6 can be connected through a resistor 267 to pins 9 and 10 of the NAND gate 263. Pin 6 of the NAND gate 265 can also be connected through a capacitor 269 to the terminal 231 at the input to the NAND gate 220 in section 217. The NAND gates 263 and 265 both provide inverters and when coupled as indicated they form a Schmitt trigger.

In the section 252, the conductor 257 can be connected through the parallel combination of a capacitor 271 and a resistor 273 to the conductor 186. The conductor 257 can also be connected in a forward direction through a diode 275 to the conductor 193.

When the alarm contact is activated by the flame detector (not shown) in the boiler it will supply 110 volts to terminal 1. This voltage will be passed through the current limiting resistor 255 to provide a five volt power supply signal across the capacitor 271. This power supply voltage will be introduced through the resistor 255 to the pins 9 and 10 of the gate 261. This five volt signal will also charge the capacitor 269 through the resistor 267.

When the alarm signal is first introduced to the terminal 1, the capacitor 269 has already been charged so that the state of the flip-flop network 219 is not changed. When the signal is removed from the terminal 1, however, the five volt supply to the network 261 is removed and the network 261 functions as a level detector switching the pin 6 to a low condition. In this low state, the network 261 will sink the current out of the capacitor 269 creating a momentary short at the pins 10, 2 and 5 of the network 219. This will change the state of the output of the NAND gate 220 to a high state and flip the network 219 to a low state. This resets the network 219 allowing the next fault to be indicated by the lamp 211'.

In the section 251, the annunciator 103 includes means for inhibiting the display of any additional information in the circuits A, B and C of the section 213 when one of the circuits A, B or C is activated. When the terminal 1 receives the alarm signal, the 5 volt signal on the conductor 257 can be introduced through a diode 277 into a conductor 279. Three resistors 281, 283 and 285 can be connected between the conductor 279 and the bases of respective transistors 287, 289 and 291. The emitters of these transistors 287–291 can be connected to the terminal 17. The collectors of the transistors 291, 289 and 287 can provide the signals indicated as $A_1$, $B_1$ and $C_1$. These signals are introduced into the terminal 223 in the respective circuits A, B and C of the section 213. Thus the signals $A_1$, $B_1$ and $C_1$ are connected across the capacitor 239 and cooperate with the resistor 221 to short circuit any output signal from the network 199'. This inhibits the transistors 227 in the networks A, B and C from turning on even though the output of the network 199' is high. Of course the first fault to occur will already have flipped the gate 222 in the associated circuit A, B or C of the section 217.

When the system is first turned on, it will take some time for the combustion air switch 61 and the atomization air switch 63 to achieve their normally closed states due to the time required for the blower of the boiler to come up to speed. Included in thee annunciator 103 of the present invention is time delay means for inhibiting fault indications of "no combustion air" and "no atomization air" during the initial startup time. This means is illustrated primarily in a section designated by the reference numeral 293.

The motor contact on the flame safeguard device is designated by the boxed letter M in the programmer 41 and in section 293 of FIG. 2. This motor contact M can be connected to terminal 21 of the annunciator 103 which is in turn connected in a forward direction to a diode 295 and a capacitor 297 to terminal 17. The cathode of the diode 295 can be connected through a resistor 299 and a conductor 301 to the cathode of a Zener diode 303. The anode of the diode 303 can be connected to the terminal 17. The diode 303 can be an 18 volt diode commonly designated by the catalog number 4746A. The conductor 301 can be connected through a resistor 305, a terminal 307, and a capacitor 309 to the terminal 17.

The emitter of a uni-junction transistor 311 can be connected to the terminal 307. The transistor 311 has a first base and a second base and can be of the type commonly designated by the catalog number 2646. The first base of the transistor 311 can be connected through a resistor 313 to conductor 301. The second base of the transistor 311 can be connected through a resistor 315 to the terminal 17. The conductor 301 can also be connected through a resistor 317 and in a forward direction through a rectifier 319 to the terminal 17. The gate of the rectifier 319 can be connected to the second base of the transistor 311. The cathode of a Zener diode 321 can be connected to the anode of the rectifier 319. The Zener diode 321 can be a 12 volt diode commonly designated by the catalog number 4722. The anode of the diode 321 can be connected in a forward direction through a diode 323 to the conductor 279 associated with the sections 251 and 252.

In operation, the 110 volt signal occurring on the motor contact M is introduced through the terminal 21 and across the diode 295 and capacitor 297. In combination with the resistor 101, these elements generate a supply voltage for a uni-junction timing circuit including the uni-junction transistor 311 and the resistors 315, 313, 305 and the capacitor 309.

When the time constant of the uni-junction timing circuit is reached at approximately half of 18 volts or 9 volts, a momentary spike is generated through the resistor 315 which is introduced into the gate of the rectifier 319. Until this occurs, the voltage at the bases of the transistors 287, 289, and 291 in the section 251 is adequate to permit these transistors to maintain an on state thereby inhibiting any information from coming in even though the associated switchs 59, 61 and 63 are open. However, when the time delay associated with the uni-junction timing circuit has timed out, the rectifier 319 is turned on and removes the base voltage from the transistors 287–291. This permits any input signal at the terminals 3–4, 7–7, and 8–6, to be passed into the memory associated with the section 217.

An additional feature of the annunciator 103 is associated with a circuit which provides means for distinguishing between no pilot and no main fuel. This circuit is shown generally in the section designated by the reference numeral 325. A conductor 327 is connected to the terminal 17 in the power supply section 115 to provide a reference signal in the section 325. Terminals 18, 19 and 20 associated with the alarm, no pilot and main fuel switches, respectively, provide 110 volt signals when they are energized. The terminal 19 can be connected in a forward direction through a diode 331, a resistor 333, a terminal 335, and a capacitor 337 to the conductor 327. Similarly, the terminal 18 can be connected in a forward direction to a diode 339, a resistor 341, a conductor 343, and a capacitor 345 to the conductor 327. In this preferred embodiment, the terminal 20 is connected in a forward direction through a diode 347, a resistor 349, a terminal 351 and a resistor 353 to the conductor 327. A Zener diode 355, which may be an eighteen volt diode commonly designated by the catalog number 4746A, can be connected in a forward direction from the conductor 327 to the conductor 343.

The 22 volt $V_{cc}$ signal on the terminal 135 in the power supply section 115 can be introduced through a resistor 357 and in a forward direction through a silicon controlled rectifier 359 to the conductor 327. The gate of the rectifier 359 can be connected through a resistor 361 and a trigger diode 363 to the terminal 335. A resistor 365 can also be connected between the gate of the rectifier 359 and the conductor 327.

To complete the circuit associated with the no pilot indication, the anode of the rectifier 359 can be connected through a resistor 367 and in a backward direction through a diode 369 to the base of a transistor 371. The emitter of the transistor 371 can be connected through the conductor 343 while the collector is connected in a forward direction through a diode 373, a resistor 375, and a terminal 377 to the base of a transistor 379. The collector of the transistor 379 can be connected through a "no pilot" indicator lamp 381 and a resistor 383 to the conductor 121 from the power supply section 115. The emitter of the transistor 379 can be connected to receive a reference potential from the conductor 327. Finally, a diode 385 can be connected in a forward direction from a terminal P to the terminal 377 to provide means for testing the no pilot lamp 381.

If the flame safeguard device is operating normally, the 110 voltage will be administered to the terminal 19. This signal provides a gate voltage to the rectifier 359 through the trigger diode 363 thereby creating a low voltage at the base of the transistor 371. If the pilot of the boiler is operating properly, no voltage will appear on terminal 18 which is connected to the alarm contact shown in the box A.

If the pilot is not functioning properly, however, the 110 voltage will be seen at the terminal 18. This signal will supply a $V_{cc}$ voltage, such as 18 volts, to the emitter of the transistor 371. This will cause the transistor 371 to conduct and thereby supply the base voltage to turn on the transistor 379. With the transistor 379 in an on state, the lamp 381 will illuminate to provide the desired "no pilot" indication.

If the pilot is functioning properly, the main fuel valve of the boiler will be turned on to provide a 110 volt voltage on the terminal 20. This signal will initially short out the holding current of the rectifier 359 through a transistor 387 having its base connected through a resistor 389 to the terminal 351. The collector of the transistor 387 can be connected to the anode of the rectifier 359 and its emitter connected to the conductor 327. A capacitor 391 can be connected from the base of the transistor 387 to the conductor 327.

The collector of the transistor 371 can be connected through a resistor 393 to the base of a transistor 395. The collector of the transistor 395 can be connected through a resistor 397 to the conductor 343 in a forward direction through a diode 399 to the base of the transistor 401. The emitters of the transistors 395 and 401 can both be connected to the conductor 327. The collector of the transistor 401 can be connected through a "no main fuel lamp" 403 and a resistor 405 to the conductor 121 from the power supply section 115.

Means for testing the lamp 403 can include a diode 407 connected in a forward direction from the terminal P to the base of the transistor 401.

If the pilot is operating properly but the main fuel valve malfunctions, a 110 volt signal will occur on the terminal 18. When this occurs, the base voltage will be supplied to the transistor 401 which will turn on thereby illuminating the lamp 403. The transistor 395 functions primarily as a safety device to maintain the "no main fuel" lamp 403 in an off mode during a "no pilot" indication.

It can be seen that the annunciator 103 is of particular advantage in indicating faults commonly associated with industrial type burner/boilers. Not only are these faults indicated, but compound faults are indicated in a particular manner so that only the first occuring fault is initially displayed. In the section 167, means is provided for generating a signal when an offset voltage occurs across the associated control switch. This signal is used to activate a driver associated with one of the lamps 211. In section 213, means is provided for particular indications of no fuel pressure, no combustion air, or no atomization air in both a recycle and nonrecycle mode of operation. If more than one of these faults occurs simultaneously in the nonrecycle mode of operation, sections 251 and 252 provide means for inhibiting those of the particular indications associated with other than the first occuring fault. Section 217 provides memory means for maintaining the indicated of the three faults even though the associated control switch is remade.

In section 293, means responsive to the motor contact M is provided for inhibiting the particular three indications during a predetermined startup period.

In section 325, means is provided for distinguishing between a "no pilot" fault and a "main fuel" fault. Means is also provided for inhibiting the "no main fuel" indication when there is a "no pilot" indication. Throughout the annunciator, means is provided for testing the lamps 211, 381 and 403.

Although the annunciator 103 has been described with reference to specific embodiments, it will be appreciated by those skilled in the art that it can be otherwise embodied so that the scope of the invention should be ascertained only with reference to the following claims.

I claim:

1. An annunciator adapted for use with a boiler having a flame safeguard programmer providing first and second signals each representative of an associated first and second fault in the boiler and with the second fault occurring subsequent to the first fault, the programmer also providing an alarm signal when the flame of the boiler goes out in response to the first fault, the annunciator comprising:

first means responsive to the first signal to provide a third signal representative of the first fault;

second means responsive to the second signal to provide a fourth signal representative of the second fault;

third means responsive to the third signal to provide a first visual indication of the first fault and responsive to the fourth signal for providing a second visual indication of the second fault, the third means having memory characteristics for maintaining the first visual indication even if the third signal ceases; and fourth means coupled to the first means and the second means and responsive to the alarm signal for inhibiting the third signal and the fourth signal; whereby only the first indication is provided by the third means during the continuance of the alarm signal.

2. The annunciator recited in claim 1 wherein the third means includes:

flip-flop means responsive to the alarm signal in the third signal to provide a fifth signal, the fifth signal continuing with the alarm signal even after the third signal is subsequently inhibited by the fourth means; and indicator means responsive to the fifth signal to provide a visual indication of the first fault.

3. The annunciator recited in claim 2 wherein the indicator means includes:

a pair of Darlington coupled transistors responsive to the fifth signal to provide an indication signal; and a lamp responsive to the indication signal to provide a visual indication of the first fault.

4. A combination for indicating a fault in a boiler having a control switch connected between first and second terminals and having a normal first state, and with the switch responsive to the fault to provide a second state and voltage across the first and second terminals, the combination comprising:

first unidirectional means connected to the first terminal and responsive to the voltage on the first terminal for producing a first signal having first characteristics;

second unidirectional means connected to the second terminal and responsive to the voltage on the second terminal for producing a second signal having second characteristics different than the first characteristics at least when the switch is in the second state;

network means responsive to the first signal with the first characteristics and the second signal with the second characteristics and providing for a third signal with the first characteristics; and indicator means responsive to the third signal with the first characteristics for providing a desired indication of the fault.

5. The combination set forth in claim 4 further comprising:

second unidirectional means included in the second means and connected to the second terminal, the second unidirectional means responsive to the signal on the second terminal for providing the second signal with the first characteristics when the switch is in the first state;

the network means responsive to the first signal with the first characteristics and the second signal with the first characteristics for providing the third signal with third characteristics different than the first characteristics; and the indicator means responsive to the third signal with the third characteristics for inhibiting the indication when the switch is in the normal first state.

6. The combination set forth in claim 5 wherein:

the first signal with the first characteristics includes a plurality of first pulses;

the second signal with the first characteristics includes a plurality of second pulses having a particular phase relationship to the first pulses in the first signal; and the network means is responsive to the first and second pulses with the particular phase relationship for providing the third signal with constant characteristics.

7. The combination recited in claim 6 wherein the network means is responsive to the first signal having the first pulses and the second signal with the second characteristics for providing the third signal with a plurality of third pulses having the particular phase relationship to the first pulses.

8. The combination recited in claim 4 wherein the network means includes means responsive to the third signal with the first characteristics for maintaining the third signal with the first characteristics even after the switch has been provided with the normal first state.

9. The combination set forth in claim 4 wherein the indicator means includes:

current control means responsive to the third signal with the first characteristic for providing a driving current; and lamp means responsive to the driving current of the current control means for providing a visual indication of the fault.

10. The combination set forth in claim 9 further comprising means for providing a fourth signal having characteristics similar to the third signal with the first characteristics and means for introducing the fourth signal to the indicator means to test the lamp means.

11. An annunciator adapted for use with a boiler including a plurality of control switches each having a first state when the boiler is functioning properly and each having a second state representative of an associated fault in the boiler, the annunciator comprising:

a plurality of indicator means each coupled to one of the switches and providing a desired indication of the specific fault corresponding to the associated switch when the associated switch is in the second state;

the indicator means including a first indicator means associated with a first fault and a second indicator means associated with a second fault; and means coupled to the first indicator means and the second indicator means for inhibiting the indication of the first indicator means when the second fault occurs prior to the first fault.

12. The annunciator recited in claim 11 wherein the boiler includes particular ones of the switches associated with particular ones of the indicator means, and the annunciator further comprising:

alarm means connected to the particular switches and responsive to the particular switches in the second state for providing an alarm signal; and means coupled to each of the particular indicator means associated with the particular switches and responsive to the alarm signal for maintaining the indications of the particular indicator means as long as the alarm signal is provided by the boiler.

13. The annunciator recited in claim 12 wherein the particular indicator means are associated with the fuel pressure switch, the combustion air switch and the atomization air switch in the boiler.

14. An annunciator adapted for use with a boiler programmer providing a no pilot signal and an alarm signal in response to a no pilot condition, the programmer providing a no main fuel signal and the alarm signal in response to a no main fuel condition, comprising:

first means responsive to the alarm signal for providing a no pilot indication in response to the no pilot signal; and second means responsive to the alarm signal for providing a no main fuel indication in response to the no main fuel signal.

15. The annunciator recited in claim 14 wherein the first means comprises:

memory means having a first state and a second state;

trigger means responsive to no pilot signal for providing the memory means with the first state; and current control means responsive to the memory means in the first state to provide a particular signal with first characteristics and responsive to the memory means in the second state to provide the particular signal with second characteristics; and means responsive to the particular signal with the first characteristics to provide the no pilot indication.

16. The annunciator recited in claim 15 comprising:

means responsive to the main fuel signal for providing the memory means with the second state; and means responsive to the alarm signal and the particular signal with the second characteristics from the current control means for providing the no main fuel indication.

17. An annunciator adapted for use with a boiler having a flame safeguard programmer providing a plurality of fault signals each representative of an associated fault in the boiler, the plurality of fault signals having characteristics for occurring simultaneously when the associated faults occur simultaneously, the annunciator comprising:

first means responsive to the first occurring of the fault signals provided by the programmer for providing a first indication signal representative of the fault associated with the first occurring of the signals and terminating with the correction of the fault associated with the first occurring of the signals;

second means responsive to the second occurring of the fault signals provided by the programmer for providing a second indication signal representative of the fault associated with the second occurring of the fault signals and terminating with the correction of the fault associated with the second occurring of the signals;

means for inhibiting the second indication signal until the fault associated with the first occurring of the fault signals has been corrected so that the second indication signal begins with the correction of the fault associated with the first occurring of the fault signals and terminates with the correction of the fault associated with the second occurring of the fault signal;

third means responsive to the first indication signal for providing a visual indication of the first fault; and fourth means responsive to the second indication signal for providing a visual indication of the second fault.

* * * * *